US006695362B2

(12) United States Patent
Klüting et al.

(10) Patent No.: US 6,695,362 B2
(45) Date of Patent: Feb. 24, 2004

(54) ROTARY-LATCH LOCK

(75) Inventors: Bernd Klüting, Radevormwald (DE); Norbert Krüger, Essen (DE)

(73) Assignee: Witte-Velbert GmbH & Co. KG, Velbert (DE)

( * ) Notice: Subject to any disclaimer, the term of this patent is extended or adjusted under 35 U.S.C. 154(b) by 0 days.

(21) Appl. No.: 10/186,317

(22) Filed: Jun. 28, 2002

(65) Prior Publication Data

US 2003/0020285 A1 Jan. 30, 2003

(30) Foreign Application Priority Data

Jul. 2, 2001 (DE) ..... 101 31 978

(51) Int. Cl.[7] ..... E05C 3/06
(52) U.S. Cl. ..... 292/216; 292/DIG. 23
(58) Field of Search ..... 292/201, 216, 292/DIG. 23, 229

(56) References Cited

U.S. PATENT DOCUMENTS

| | | | | | |
|---|---|---|---|---|---|
| 3,930,665 | A | * | 1/1976 | Ikawa | 280/751 |
| 4,010,967 | A | * | 3/1977 | Renteria, Jr. | 292/251.5 |
| 4,165,112 | A | * | 8/1979 | Kleefeldt | 292/216 |
| 4,221,413 | A | * | 9/1980 | Bonnetain | 293/122 |
| 4,756,564 | A | * | 7/1988 | Ikeda | 292/216 |
| 4,783,103 | A | * | 11/1988 | Schlegel | 292/216 |
| 4,869,536 | A | * | 9/1989 | Kleefeldt | 292/210 |
| 5,020,838 | A | * | 6/1991 | Fukumoto | 292/201 |
| 5,308,128 | A | * | 5/1994 | Portelli et al. | 292/216 |
| 5,454,608 | A | * | 10/1995 | Dzurko et al. | 292/216 |
| 5,649,726 | A | * | 7/1997 | Rogers et al. | 292/201 |
| 5,746,419 | A | * | 5/1998 | McFadden et al. | 267/140 |
| 5,971,448 | A | * | 10/1999 | Hayakawa et al. | 292/216 |
| 5,971,449 | A | * | 10/1999 | Rogers et al. | 292/216 |
| 6,109,671 | A | * | 8/2000 | Roncin et al. | 292/216 |
| 6,428,059 | B2 | * | 8/2002 | Kobayashi et al. | 292/216 |

FOREIGN PATENT DOCUMENTS

| | | |
|---|---|---|
| DE | 2803351 | 8/1979 |

* cited by examiner

*Primary Examiner*—Robert J. Sandy
*Assistant Examiner*—Thomas Ho
(74) *Attorney, Agent, or Firm*—Martin A. Farber

(57) ABSTRACT

A rotary-latch lock (1), of which a rotary latch (8) has a fork mouth (9) for accommodating a mating locking part (6) which, in a locked position of the rotary-latch lock (1), is located in front of a blocking flank (16) formed by a fork-mouth leg (11), having a window-like opening (17, 25, 26) which promotes plastic deformation when the blocking flank (16) is subjected to increased loading, wherein the opening (17, 25, 26) forms a bending/extending web (18, 23, 24).

13 Claims, 3 Drawing Sheets

ROTARY-LATCH LOCK

FIELD AND BACKGROUND OF THE INVENTION

The invention relates to a rotary-latch lock, of which the rotary latch has a fork mouth for accommodating a mating locking part which, in the locked position of the lock, is located in front of a blocking flank formed by a fork-mouth leg, having a window-like opening which promotes plastic deformation when the blocking flank is subjected to increased loading.

A rotary-latch lock of the type in question is known from DE A 28 03 351, which rotary-latch lock is used for the releasable locking of a backrest of a vehicle seat. The window-like opening of the relevant fork-mouth leg is configured as a loading-relief bore and provided beneath a run-on slope in the fork-mouth leg. This makes it possible to form between the loading-release bore and the run-on slope, in the event of a crash, a plastically deformable region which prevents the rotary latch from sliding off from the mating locking part. On account of the particular bore-like outline of the window-like opening, largely controlled plastic deformation takes place, to be precise in the region where the spacing is smallest between the bore and the run-on slope and/or the corresponding section of the blocking flank. In the case of this configuration, however, it is not possible to avoid the situation where stress peaks occur on the rotary latch under increased loading, which is the case, for example, in the event of a crash, it being possible for said stress peaks, in some circumstances, to result in the rotary latch breaking, to be precise in the region of the rotary-latch weak point formed by the fork mouth.

SUMMARY OF THE INVENTION

The object of the invention is to configure a rotary-latch lock of the generic type such that even high loading forces acting on the rotary latch do not result in any functional incapability of the rotary latch.

This object is achieved with a rotary-latch lock having the features of the introductory-mentioned paragraph, wherein the opening forms a bending/extending web.

The following subject matter of the invention may be important alone or in combination with the above-mentioned independent features of the invention.

Such a configuration provides a rotary-latch lock of the generic type which has an increased safety value. The opening which forms a bending/extending web results in compensation for stress peaks in the event of a crash and/or under increased loading and reliably avoids the risk of the relevant fork-mouth leg tearing or breaking. This means that the functional capability of the rotary-latch lock is maintained even following a crash. This is important, in particular, if the rotary-latch lock is assigned to vehicle doors which, once the vehicle has been involved in a crash or accident, have to be opened in order for it to be possible for any injured individuals to be rescued quickly. The essential plastic deformation in the event of a crash takes place in the region of the bending/extending web. Deliberately controlled deformation is thus realized. An advantageous variant of the invention is distinguished in that the bending/extending web runs parallel to the blocking flank. Accordingly, the essential plastic deformation is assigned to the rotary latch. The slot configuration of the window-like opening compensates for installation tolerances, with the result that the effectiveness which is sought after according to the invention is not impaired. The essential plastic deformation in the event of a crash takes place in the region between the slot and the blocking flank. The rest of the rotary latch is subjected to a lower level of deformation. At the same time, it is possible, overall, for the relevant fork-mouth leg to warp to a certain extent without this resulting in the material of the rotary latch tearing. Furthermore, the bending/extending web may be part of the bearing eyelet for the rotary bearing of the rotary latch and/or catch. Even then, the bending/extending web can run parallel, to be precise concentrically in relation to the relevant articulation pin. In addition, it is also possible for the bending/extending web to be arranged parallel to the blocking flank. Provision is then made for the stresses which occur under the increased loading in the region of the fork-mouth root to be reduced as a result of the opening extending into the fork-mouth root. The region of the rotary latch, which is thus very much at risk, is reliably protected as a result. Emphasis should also be given to the fact that the length of the web is considerably greater than the diameter of the mating locking part and of the bearing eyelet. This greater length is available for warping in the event of a crash, with the stress peaks which occur in this case being reduced in the process. It proves to be optimal if the mating locking part or the articulation pin, which engages through the bearing eyelet, butts approximately centrally against the web. In order largely to eliminate stress peaks which occur in the region of the fork-mouth root, the opening section which is assigned to the fork-mouth root follows the curvature of the blocking flank and/or of the bearing eyelet. A further advantageous feature is that the window width corresponds approximately to half the diameter or the radius of the mating locking part and bearing eyelet. Under increased loading, accordingly, the bending of the bending/extending web is not adversely affected to any significant extent. Variations in the dissipation of stress peaks may be realized in that the rotary latch and/or the catch, in particular the opening, are/is sheathed in plastic. It is possible here for the opening to contain a compressible plastic filling. The bending deformation is additionally controlled by this plastic filling. Production-related advantages are achieved in that the plastic filling is configured integrally with the sheathing. This configuration is varied, furthermore, in that the plastic filling has webs which form cavities. These webs may be oriented in different ways. A zigzag arrangement of the webs is also recommended.

A number of exemplary embodiments of the invention are explained hereinbelow with reference to the drawings, in which:

DETAILED DESCRIPTION OF THE PREFERRED EMBODIMENT

Figure 1:
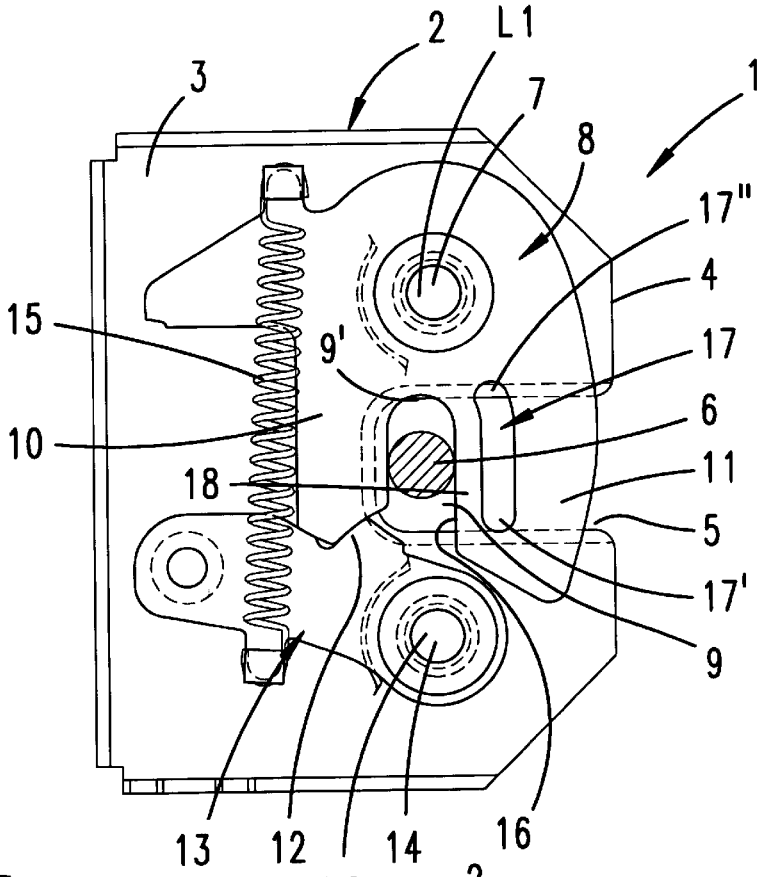
FIG. 1 shows a view of a rotary-latch lock with rotary latch, trapping a mating locking part, under normal loading.
Figure 2:
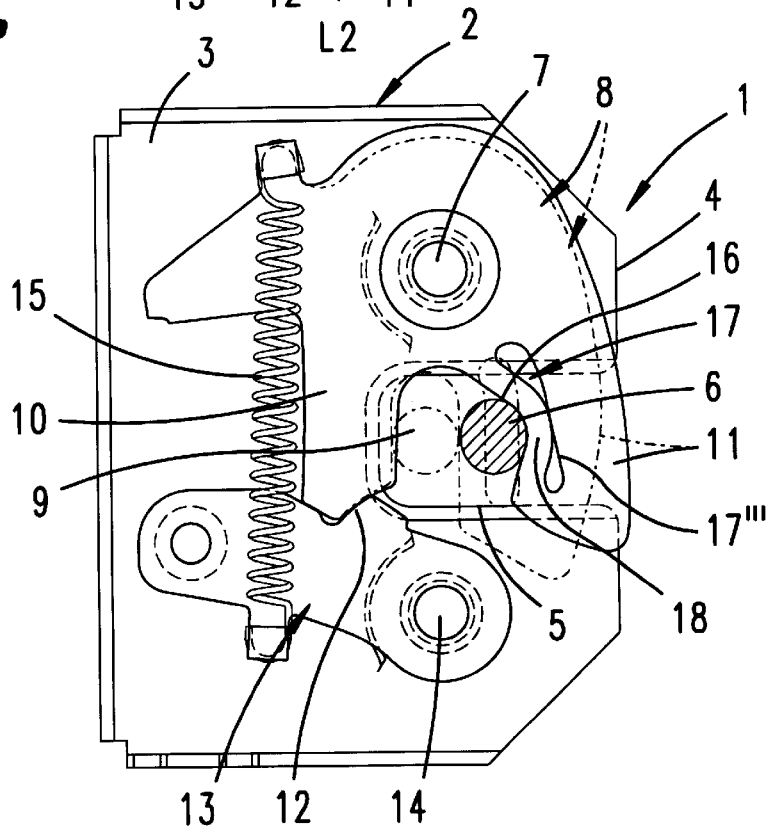
FIG. 2 shows an illustration as in FIG. 1, but with the rotary latch being subjected to increased loading.

The rotary-latch lock, which is designated 1 overall, according to the first embodiment illustrated in FIGS. 1 and 2 has a lock housing 2. The latter has a housing base plate 3. An entry opening 5 of approximately rectangular outline for a mating locking part 6 extends from one flank 4 of said housing base plate. The rotary-latch lock 1 is preferably secured on a vehicle door, while the mating locking part 6 is fastened on the bodywork. The mating locking part 6 is a bolt of circular cross section.

To the side of the entry opening 5, the lock housing 2 bears an articulation pin 7 for a rotary latch 8, which articulation pin 7 engages through a bearing eyelet L1 of the rotary latch 8. This forms an open-border fork mouth 9, on both sides of which fork-mouth legs 10, 11 remain, the fork-mouth leg 10 being of smaller width. In the locked position, the blocking tooth 12 of a catch 13 acts on the free end of the fork-mouth leg 10. Said catch is mounted on the other side of the entry opening 5, about an articulation pin 14 which passes through a bearing eyelet L2 of the catch 13 and belongs to the lock housing 2. A tension spring 15, which extends between the rotary latch 8 and the catch 13, subjects the catch 13 to loading in the blocking direction and the rotary latch 8 to loading in the opening direction. The rotary-latch lock 1 can be opened at will in a known manner in that the catch 13 is subjected to the action of an element which is not illustrated but by means of which the catch can be moved into the release position. This, however, belongs to the prior art, and so no more details will be given in this respect.

In the locked position of the rotary-latched lock, the fork-mouth leg 11, which is wider than the fork-mouth leg 10, is directed transversely to the entry opening 5 and bridges the latter. The fork-mouth leg 11 in this case forms a blocking flank 16 running transversely to the entrance and exit direction of the mating blocking part 6. Parallel to said blocking flank, the fork-mouth leg 11 is provided with an opening 17 configured as a slot. Said opening is made up of a rectilinear opening section 17' and a rounded opening section 17", which is assigned to the fork-mouth root 9'. The length of the rectilinear opening section 17' corresponds more or less to the extent of the entry opening 5, while the opening section 17", which follows the curvature of the blocking flank 16 and is assigned to the fork-mouth root 9', projects slightly beyond the root 9'. As can be seen from FIGS. 1 and 2, in the locked position, the mating locking part 6 extends approximately in the center of the bending/extending web 18 remaining between the blocking flank 16 and the opening 17. On account of the previously described configuration of the opening 17, the length of said web is considerably greater than the diameter of the mating locking part 6. It can then be seen from FIG. 1 that the window width or the extent of the opening 17 corresponds approximately to the radius of the mating locking part 6.

In the event of a crash, the situation according to FIG. 2 may occur. In the case of a motor-vehicle door trying to burst open, the blocking flank 16 is subjected to increased loading. The mating locking part 6 in this case acts on the bending/extending web 18 to a pronounced extent and results in plastic deformation of the same, it being possible for said web to bend at an obtuse angle on account of the slot-like opening 17. The vertex of this bending reaches as far as the outer opening edge 17'". Stress peaks which occur in the case of this plastic deformation are eliminated on account of this buffer action, with the result that the rotary latch 8 cannot tear in the region of the fork-mouth root 9'. The rotary latch 8 thus remains functionally capable, with the result that subsequent opening of the rotary-latch lock is ensured.

The illustration according to FIG. 2 shows the initial position of the rotary latch 8 by chain-dotted lines. The solid-line illustration of the rotary latch here shows the deformation, in particular of the blocking fork-mouth leg 11.

Figure 3:
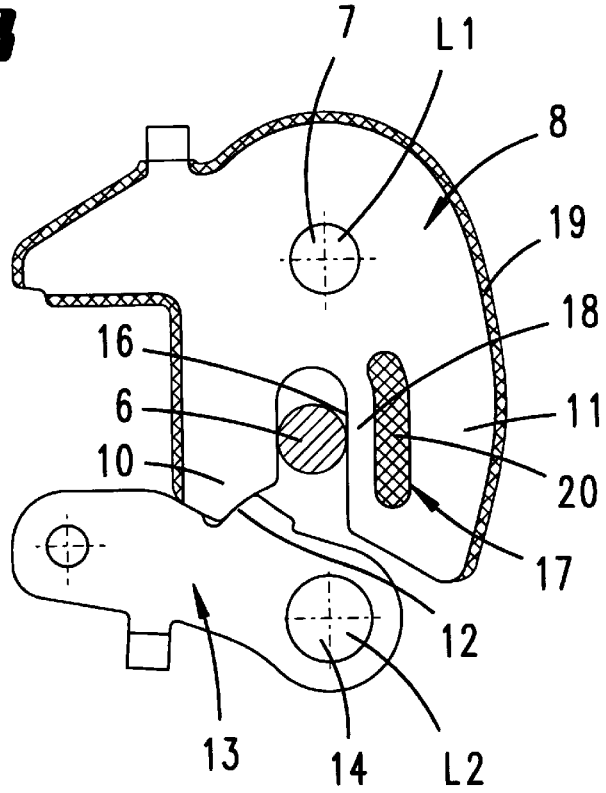
FIG. 3 shows a second embodiment of the rotary latch, which is sheathed in plastic and contains a compressible plastic filling in the opening.

FIG. 3 shows a modified configuration of a rotary latch 8. The same parts are provided with the same designations. In contrast, then, the rotary latch 8 is provided with plastic sheathing 19. The opening 17 then contains a plastic filling 20. The latter is integral with the plastic sheathing 19 and is preferably produced at the same time as the rotary latch 8 is sheathed.

On account of the compressible plastic filling 20, an additional component is included in respect of absorbing the stress peaks. It is possible to use materials with differing compression behavior. In this respect, it is also possible to vary the slot configuration.

Figure 4:
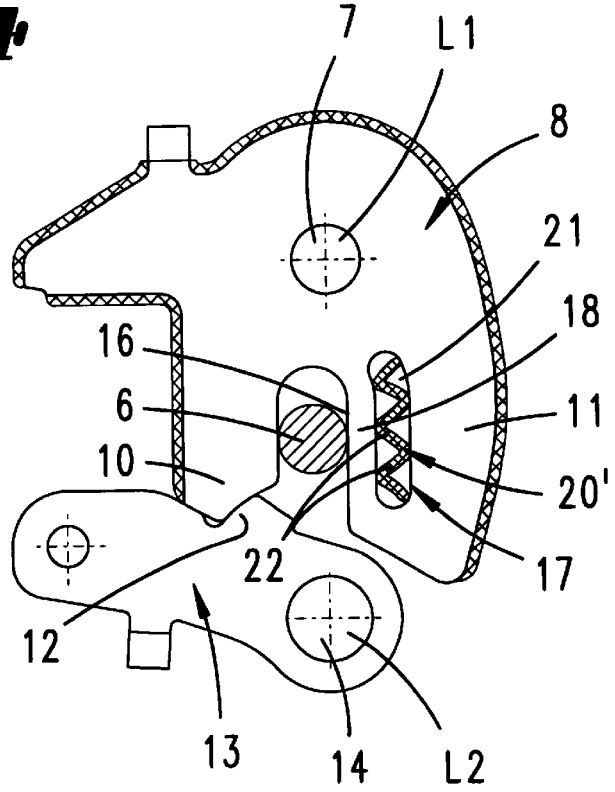
FIG. 4 shows a third embodiment of the rotary latch, in the case of which the opening has webs which form plastic-free cavities, to be precise in the form of a zigzag arrangement.

The third embodiment, which is illustrated in FIG. 4, is related to the configuration according to FIG. 3. In contrast, then, the plastic filling 20' has webs 22 which leave cavities 21 and are arranged in zigzag form, the vertex of the webs extending as far as the wall of the opening 17. This configuration makes it possible to realize a further-modified deformation behavior in a crash situation.

Figure 5:
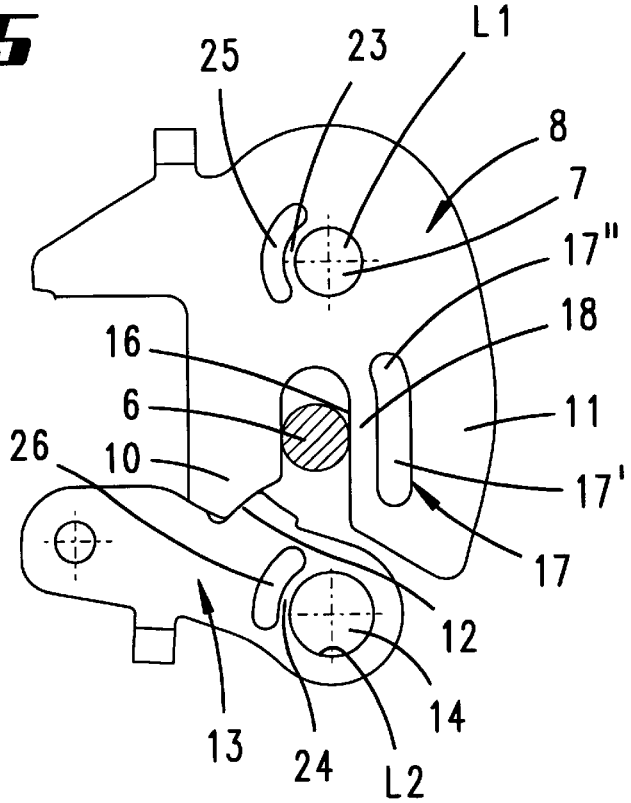
FIG. 5 shows a fourth embodiment of the rotary latch alongside its associated catch.
Figure 6:
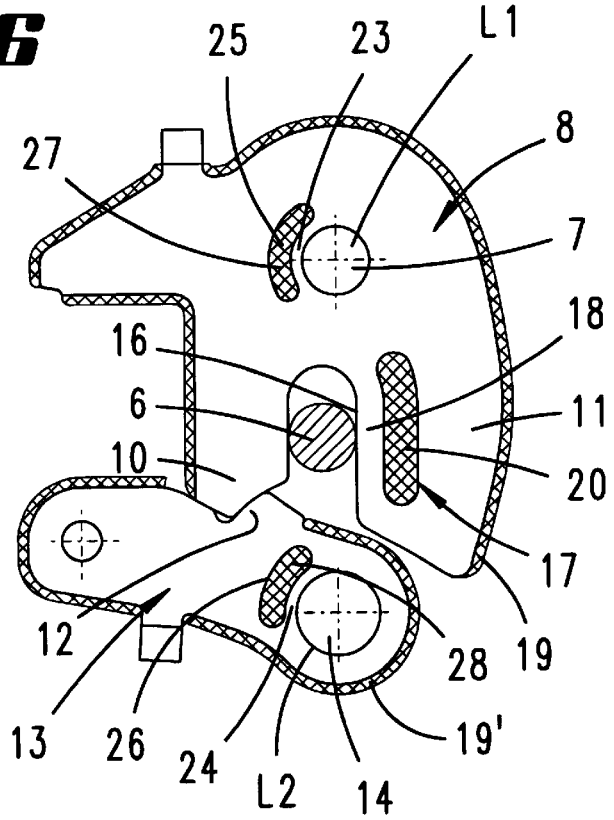
FIG. 6 shows a fifth embodiment of a rotary latch with catch.

The fourth embodiment which is illustrated in FIG. 5, is largely related to the first embodiment according to FIGS. 1 and 2. The same designations have been adopted. In addition to the bending/extending web 18, two further bending/extending webs 23 and 24 are provided. The bending/extending web 23 is part of the bearing eyelet L1. It is formed by an opening 25 running concentrically in relation to the axis of the articulation pin 7. The opening 25 is located on that side of the articulation pin 7 which is located opposite the blocking flank 16. Furthermore, the length of the opening 25 is dimensioned such that the length of the web 23 is greater than the diameter of the bearing eyelet L1.

The bending/extending web 24, in contrast, is assigned to the catch 13. The bending/extending web 24 is formed by an opening 26 running concentrically in relation to the axis of the articulation pin 14 for the catch 13. This opening, too, is dimensioned such that the length of the web 24 is greater than the diameter of the bearing eyelet L2. The opening 26 extends between the blocking tooth 12 and the articulation pin 14. All the bending/extending webs 18, 23 and 24 are thus positioned such that, in the event of a crash, they can deform plastically and dissipate stress peaks occurring in the process.

In contrast to what is illustrated, it would be possible to provide just one additional bending/extending web 23 or 24, to be precise in addition to the bending/extending web 18.

FIG. 5 shows that the articulation pin 7, 14, which engages through the bearing eyelet L1, L2, is assigned centrally to the bending/extending web 23, 24.

The fifth embodiment corresponds to a combination of the second embodiment according to FIG. 3 and of the fourth embodiment according to FIG. 5. The same parts have the same designations. The plastic sheathing 19 is integral not just with the plastic filling 20 of the opening 17, but also with the plastic filling 27 of the opening 25. Furthermore, the catch 13 also has a plastic sheathing 19' which, with a plastic filling 28 for the opening 26 being formed in the process, is used for dissipating stress peaks in the event of a crash. These plastic fillings 27, 28 provide an additional variation in the deformation behavior of relevant components in the event of the vehicle crashing.

What is claimed is:

1. A rotary-latch lock (1) comprising:

a rotary latch (8) having a fork mouth (9) for receiving a mating locking part (6) which, in a locked position of the rotary-latch lock (1), is located in front of a blocking flank (16) formed by a fork-mouth leg (11) of the rotary latch (8); said fork-mouth leg (11) having a window-like opening (17, 25, 26) which promotes plastic deformation when the blocking flank (16) is subjected to increased loading;

wherein the opening (17, 25, 26) forms a bending/extending web (18, 23, 24) having said blocking flank;

wherein the window-like opening (17) is located behind the web (18) on a side of the fork-mouth (9) opposing a path of travel of the locking part (6) from the locked position to an unlocked position within the fork mouth (9), the window-like opening (17) extending transverse to the path of travel from a locked position of the locking part (6) to promote said plastic deformation, and said fork-mouth leg (11) supports opposed ends of said web and said blocking flank to provide for a bending of said web during said plastic deformation.

2. The rotary-latch lock as claimed in claim 1, wherein the bending/extending web (18) runs parallel to the blocking flank (16).

3. The rotary-latch lock as claimed in claim 1, wherein the bending/extending web (23, 24) is part of a bearing eyelet (L1, L2) for a rotary bearing of the rotary latch and/or catch.

4. The rotary-latch lock as claimed in claim 1, wherein stresses which occur under increased loading in a region of a root (9') of the fork mouth (9) are reduced as a result of the opening (17) extending beyond the fork-mouth root (9').

5. The rotary-latch lock as claimed in claim 3, wherein the length of the web (18, 23, 240) is considerably greater than the diameter of the mating locking part (6) and of the bearing eyelet (L1, L2).

6. The rotary-latch lock as claimed in claim 3, wherein the mating locking part (6) or the articulation pin (7, 14), which engages through the bearing eyelet (L1, L2), butts approximately centrally against the web (18, 23, 24).

7. The rotary-latch lock as claimed claim 1, wherein the opening section (17"), which is coordinated to a fork-mouth root (9'), follows a curvature of the blocking flank (16).

8. The rotary-latch lock as claimed in claim 3, wherein window width corresponds approximately to half the diameter or the radius of the mating locking part (6) and of the bearing eyelet (L1, L2).

9. The rotary-latch lock as claimed in claim 1, wherein at least a portion of the lock, including at least one of the rotary latch (8), a catch (13), and the opening (17, 25, 26), is sheathed in plastic.

10. The rotary-latch lock as claimed in claim 1, wherein the opening (17, 25, 26) contains a compressible plastic filling (20, 20', 27, 28).

11. The rotary-latch lock as claimed in claim 10, wherein the plastic filling (20, 20', 27, 28) is formed integrally with sheathing (19, 19').

12. The rotary-latch lock as claimed in claim 10, wherein the plastic filling (20') has webs (22) which form cavities (21).

13. The rotary-latch lock as claimed in claim 12, wherein the webs (22) are arranged in zigzag form.

* * * * *